US005381389A

United States Patent [19]

Shimbo

[11] Patent Number: 5,381,389

[45] Date of Patent: Jan. 10, 1995

[54] TIMEKEEPING SYSTEM FOR TIMING OF A START SIGNAL

[75] Inventor: Naoyuki Shimbo, Urawa, Japan

[73] Assignee: Hitachi Denshi Kabushiki Kaisha, Tokyo, Japan

[21] Appl. No.: 215,730

[22] Filed: Mar. 22, 1994

[30] Foreign Application Priority Data

Mar. 22, 1993 [JP] Japan ..... 5-086716

[51] Int. Cl.[6] ..... G04F 8/00; G04F 10/00

[52] U.S. Cl. ..... 368/110; 368/113

[58] Field of Search ..... 368/3, 6, 9, 107, 110–113

[56] References Cited

U.S. PATENT DOCUMENTS

| | | | |
|---|---|---|---|
| 4,074,117 | 2/1978 | DeLorean et al. | 340/323 R |
| 4,451,158 | 5/1984 | Selwyn et al. | 368/63 |
| 4,456,383 | 6/1984 | Speckhart et al. | 368/9 |
| 5,105,395 | 4/1992 | Imhof | 368/9 |
| 5,194,861 | 3/1993 | St. Clair | 368/8 |

*Primary Examiner*—Vit W. Miska

*Attorney, Agent, or Firm*—Antonelli, Terry, Stout & Kraus

[57] ABSTRACT

A trigger signal generated by a start pistol is inputted to a timekeeping device. The trigger signal is synchronized with reference clock pulses and then transmitted to competitors as sound and light start signals. In addition, counting in a timekeeping counter is started at the timing of this signal.

5 Claims, 3 Drawing Sheets te
1 ms 0s
0.001s
0.002s

TIMEKEEPING SYSTEM FOR TIMING OF A START SIGNAL

BACKGROUND OF THE INVENTION

The present invention relates to a timekeeping system in which timing of a start signal for notifying competitors is made coincident with timing of start of timekeeping in a speed competition, for example.

A system block diagram according to a conventional technique is shown in FIG. 3. Conventionally in speed competitions, a start signal transmission device 14 for notifying competitors of start timing and a timekeeping device 15 for measuring goal line passing time are independent in processing of a competition start signal. A start signal emitted by a start pistol 1 is passed through a buffer circuit 4 and then distributed to two systems. One is that the start signal is distributed by a start signal distributor circuit 5 to activate a speaker 2 and a luminous portion of the start pistol 1, competitors being thus notified of start by sound and light signals. The other one is that the start signal passed through the buffer circuit 4 is transmitted to the timekeeping device 15 via a transmission cable 6. Upon receiving this signal, a counter circuit 10 begins to count clock pulses of a reference timer 8 included in the timekeeping device.

In this scheme, however, the reference timer 8 included in the timekeeping device serves as a frequency divider for output of a reference quartz oscillator 9 and generates clock pulses. The counter circuit 10 counts the clock pulses to derive elapsed time from the competition start. Since the start signal emitted from the start pistol 1 is not in synchronism with the clock pulses derived by dividing the frequency of the reference quartz oscillator 9, as shown in FIG. 2, a start signal of a waveform (C) is delayed by a time $t_e$ corresponding to at most one clock of clock pulses generated by the reference timer having a waveform (B) in comparison with the start signal of a waveform (A) issued by the start pistol 1.

Assuming now that the clock pulse derived from the frequency divider has a period of 1 ms and measurement is made by using the conventional scheme, an error of at most 1 ms is caused between the time whereat competitors know the start by means of a sound or light signal and the result of time measurement.

Furthermore, if this timekeeping device has an electronic slit camera for taking line images of competitors passing over the goal line by using a linear sensor 17, the linear sensor is scanned in synchronism with the reference timer clock supplied from the reference timer 8. In the same way as the result of time measurement, therefore, an error of at most 1 ms is caused in the images taken for decision as well.

Furthermore, the system for the speaker 2 and the luminous portion of the start pistol 1 is independent of the system for transmitting the start signal to the timekeeping device via the transmission cable 6. Therefore, even if the start signal should not be transmitted because of abnormality on the transmission cable 6 for the timekeeping device such as breaking of a wire, competitors start in response to the sound and light signals generated by the start signal transmission device 14. Thus there is a risk of running a race without measuring the goal time.

SUMMARY OF THE INVENTION

An object of the present invention is to eliminate the time difference between the time emitting the sound or light signals and the counter circuit for clock pulse.

Another object of the present invention is to provide a timekeeping device which is free from a timekeeping error caused as described above and which inhibits competitors from starting in case the counter in the timekeeping device is not working.

In accordance with the present invention, the above described objects are achieved by inputting the start signal from a start pistol functioning as a start commanding device once to a timekeeping device, returning the signal to a start signal transmission device at the same timing as clock pulses of a reference timer of the timekeeping device begin to be counted, activating a speaker and a luminous portion of the start pistol by using the signal, and thereby notifying competitors of start timing by means of sound and light signals.

In accordance with the present invention, a start signal is triggered by a start pistol functioning as a start commanding device and led to a timekeeping device via a transmission cable. In the timekeeping device, clock pulses derived from an internal reference timer are not in synchronism with the inputted start signal. Therefore, the start signal is synchronized with the clock pulses by a synchronizing circuit. At the same time as clock pulse counting is started, the signal is returned to the start pistol side via the transmission cable as the start signal synchronized with timer start in the timekeeping device. Thus, light is emitted from the start pistol and a start tone for a speaker is generated.

As a result, the light and sound signals for notifying competitors of start completely coincide with the timer start in the timekeeping device. In addition, in case there is an abnormality on the transmission cable such as breaking of a wire, competitors are prevented from starting in such a state that the timer is not started.

DESCRIPTION OF THE PREFERRED EMBODIMENTS

Figure 1:
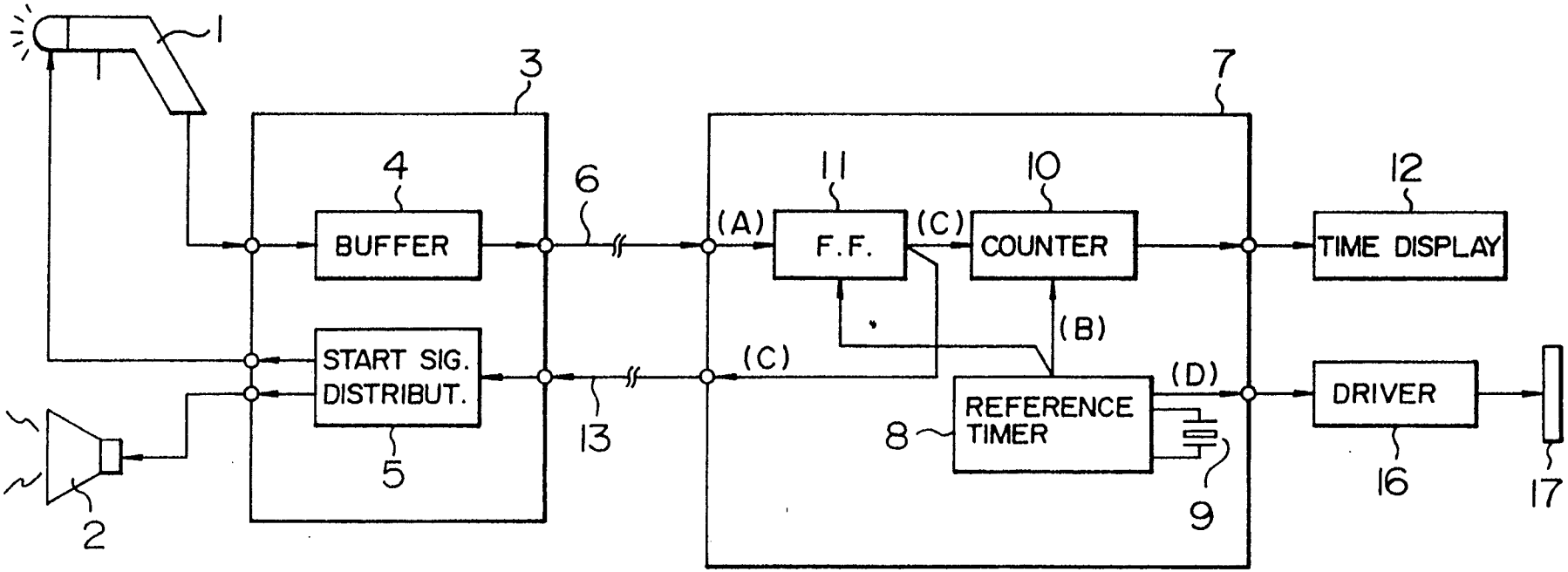
FIG. 1 is a block diagram showing an embodiment of the present invention.

An embodiment of the present invention will hereafter be described by referring to FIGS. 1 and 2. (A) through (D) of FIG. 2 show signal waveforms at locations (A) through (D) of FIG. 1, respectively.

Figures 2A, 2B, 2C, 2D:
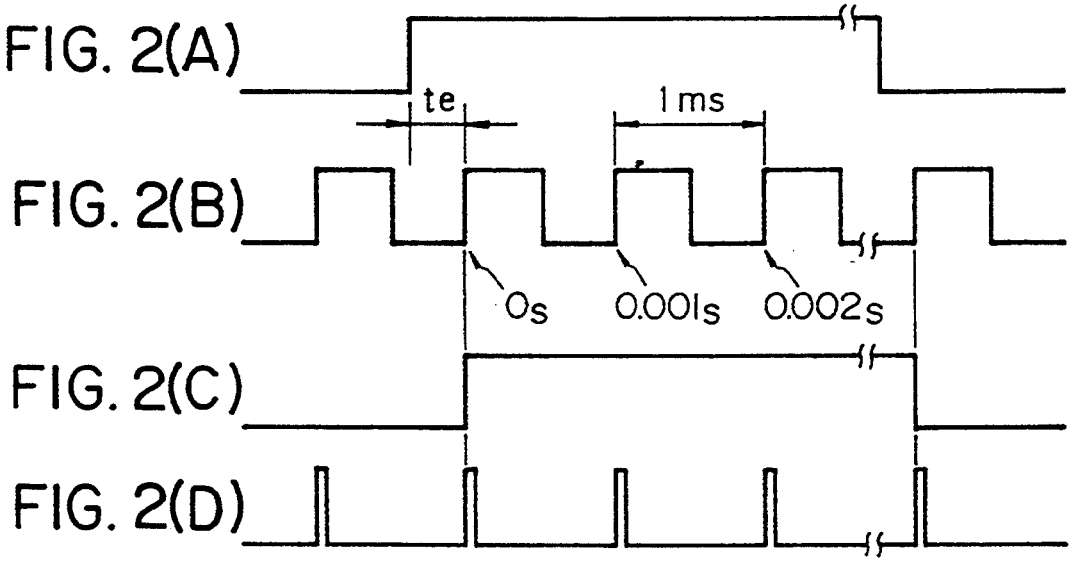
FIG. 2 is a timing chart of a competition start signal according to an embodiment of the present invention.
Figure 3:
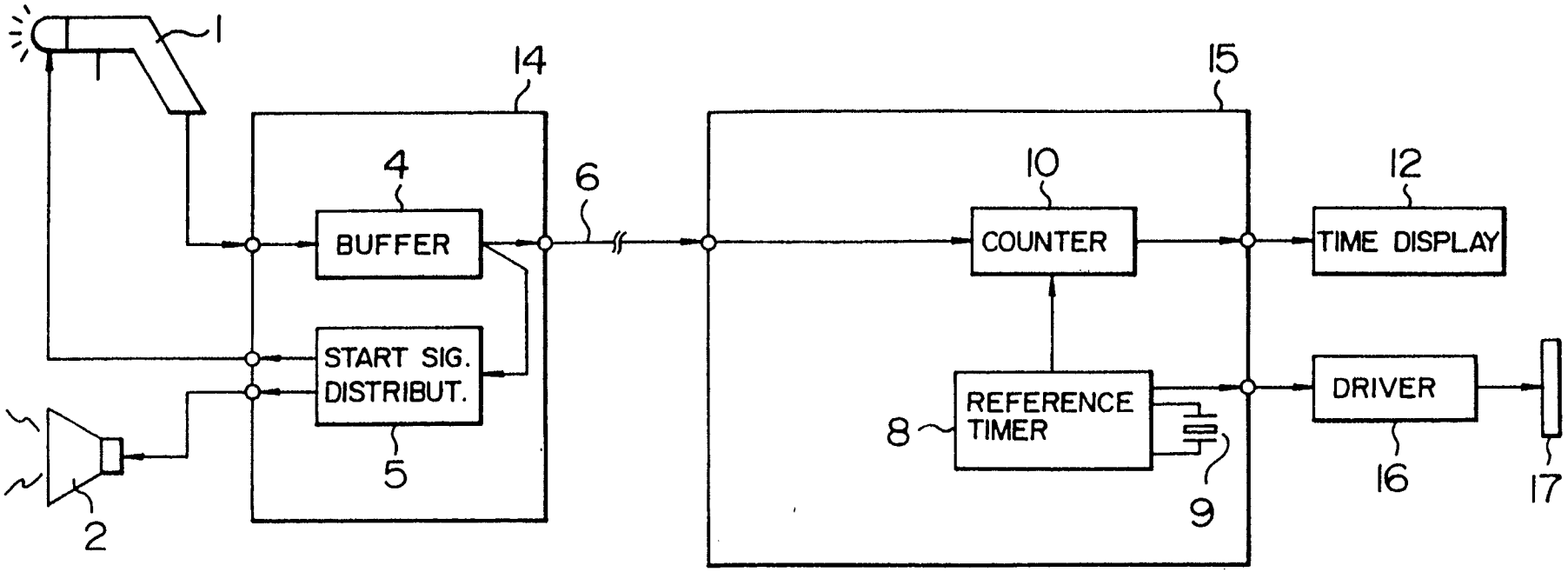
FIG. 3 PRIOR ART
FIG. 3 is a block diagram showing a conventional scheme.

With reference to FIG. 1, a start command signal (A) from a start pistol 1 is supplied to a timekeeping device 7 via a buffer amplifier 4 included in a start signal transmission device 3 and a transmission cable 6 (FIG. 2(A)). A D type flip-flop 11 generates a start signal (C) in synchronism with the rising edge of a clock pulse (FIG. 2(B)) derived from a reference timer 8.

A counter 10 is started by the start signal (C) to count clock pulses supplied from the reference timer 8. The counter counts rising edges of the clock pulses to measure the elapsed time from the start. The count is sent to a time display device 12, the elapsed time of the competition being thus displayed.

At the same time, the start signal (C) synchronized with the clock pulses of the reference timer is sent to the start signal transmission device 3 via a transmission cable 13. The start signal (C) is distributed by a start signal distributor circuit 5 to drive the start pistol 1 and a speaker 2. Competitors are thus notified of start timing by means of light emission and sound generation.

Furthermore, the reference timer 8 supplies pulses having the waveform (D) obtained from rising edge signals of the clock pulses to a driver circuit 16 for a linear sensor 17. The pulses are used as drive pulse signals for resetting main scanning. Thus, image taking squared with the start signal and synchronized with counting for elapsed time of the competition is conducted.

In the description of the embodiment, the start signal transmission device has been separated from the timekeeping device. However, they can be arranged freely.

According to the present invention, the signal using light, sound and display for starting competitors can be made coincident with the timer start of the timekeeping device for measuring the goal time of competitors. Even if there is an abnormality such as breaking of a wire in the transmission cable, competitors are prevented from starting without starting the timer of the timekeeping device. As a result, a timekeeping system having high precision and high reliability can be realized.

I claim:

1. A timekeeping system comprising:

start commanding means for generating a start command signal;

reference clock generating means for generating reference clock pulses for timekeeping;

start signal generating means for generating a start signal in synchronism with a reference clock pulse received after receiving said start command signal, said start signal generation means being connected to said start commanding means and said reference clock generating means;

start signing means for notifying competitors of competition start timing in response to the start signal supplied from said start signal generating means; and timekeeping means for measuring elapsed time after said start signal has been generated by counting reference clock pulses supplied from said reference clock generating means in response to the start signal supplied from said start signal generating means.

2. A timekeeping system according to claim 1, wherein said start commanding means is connected, via a transmission cable, to the start signal generating means disposed at a distance from said start commanding means.

3. A timekeeping system according to claim 1, wherein said start signal generating means is connected, via a transmission cable, to the start signing means disposed at a distance from said start signal generating means.

4. A timekeeping system according to claim 1, wherein the start commanding means and the start signing means disposed adjacent to each other are connected, respectively via transmission cables, to the start signal generating means disposed at a distance from said start commanding means and said start signing means.

5. A timekeeping system according to claim 1, further comprising:

a linear sensor for converting optical images of moving bodies participating in a competition and passing over a decision reference line corresponding to a goal line of the competition into electric signals; and means for scanning said linear sensor in synchronism with the reference clock pulses supplied from said reference clock generating means.

* * * * *